United States Patent [19]

Abraham

[11] 4,016,937

[45] Apr. 12, 1977

[54] APPLIANCE FOR COIN-OPERATED DEVICES

[76] Inventor: Norman J. Abraham, 12524 Lorain Ave., Cleveland, Ohio 44111

[22] Filed: Aug. 18, 1975

[21] Appl. No.: 605,512

[52] U.S. Cl. ..... 273/1 R; 273/1 E; 40/323; 116/120; 133/6; 340/280; 273/3 R; 273/14

[51] Int. Cl.[2] ..... A63F 9/00

[58] Field of Search ..... 273/3 R, 14, 1 R, 1 E; 340/323, 325, 280; 206/.83, .84; 133/6; 116/120; 40/323

[56] References Cited

UNITED STATES PATENTS

| | | | |
|---|---|---|---|
| 1,051,523 | 1/1913 | Stewart | 273/14 |
| 1,122,894 | 12/1914 | Fisher | 273/14 |
| 1,378,227 | 5/1921 | Greenstreet | 133/6 |
| 1,509,861 | 9/1924 | Coleman | 133/6 |
| 1,563,034 | 11/1925 | Levine | 133/6 X |
| 1,612,342 | 12/1926 | Alstrand | 133/6 X |
| 2,252,586 | 8/1941 | Swanson | 133/6 X |
| 2,408,751 | 10/1946 | Breiter et al. | 133/6 |
| 2,674,675 | 4/1954 | Lambert | 340/280 |
| 3,047,144 | 7/1962 | Wissel | 206/183 |
| 3,146,781 | 9/1964 | De George | 133/6 |
| 3,576,174 | 4/1971 | Topel | 116/121 |
| 3,861,678 | 1/1975 | Fansler | 273/3 R |

FOREIGN PATENTS OR APPLICATIONS

| | | | |
|---|---|---|---|
| 1,011,440 | 12/1965 | United Kingdom | 206/.84 |

*Primary Examiner*—William H. Grieb

*Attorney, Agent, or Firm*—Woodling, Krost, Granger & Rust

[57] ABSTRACT

An appliance is disclosed for illustrating the prospective order of use by a plurality of users of a coin-operated device having coin receiving means. The invention comprises a support having a plurality of coin retaining means each being capable of retaining a coin insertable within the coin-operated device. Display means displays the order in which a plurality of coins are placed in the plurality of coin retaining means by a plurality of users, respectively. Indicator means indicate the one of the plurality of coin retaining means corresponding to the present user of the coin-operated device. The appliance is mounted to enable inspection thereof to indicate the order of prospective use of the coin-operated device in accordance with the display and indicator means. The foregoing abstract is merely a resume of one general application, is not a complete discussion of all principles of operation or applications, and is not to be construed as a limitation on the scope of the claimed subject matter.

25 Claims, 17 Drawing Figures

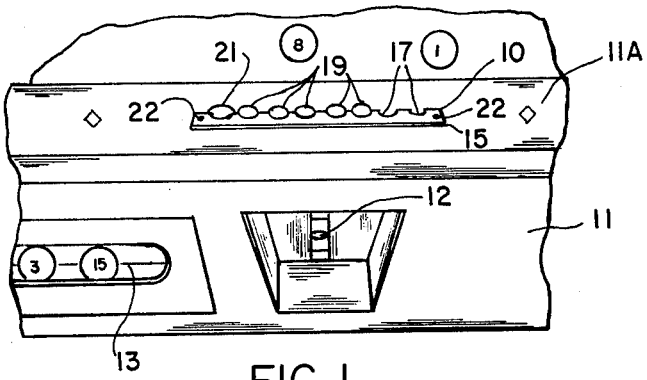
FIG. 1
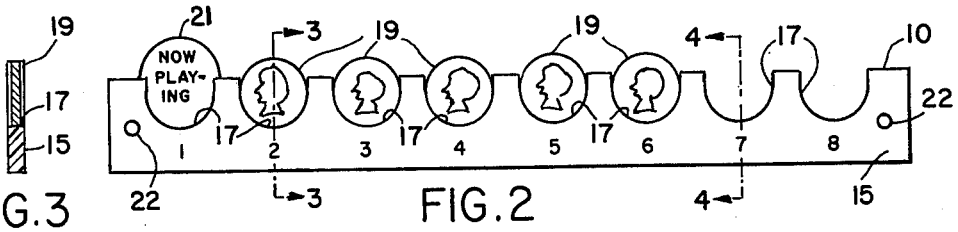
FIG. 2
FIG. 3
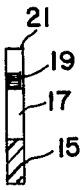
FIG. 4
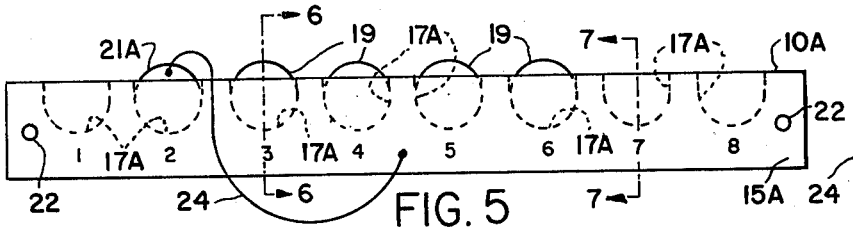
FIG. 5
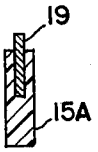
FIG. 6
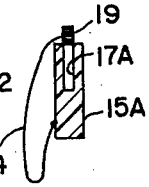
FIG. 7
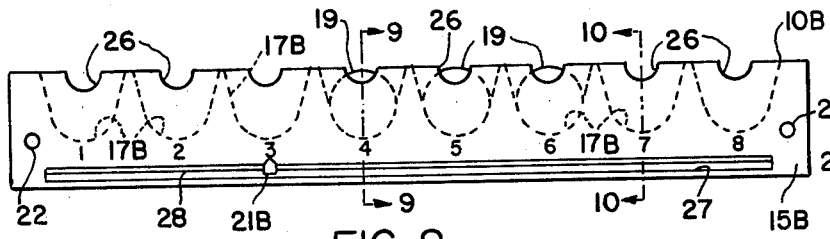
FIG. 8
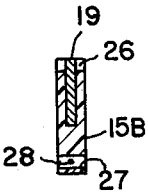
FIG. 9
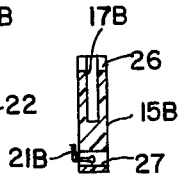
FIG. 10
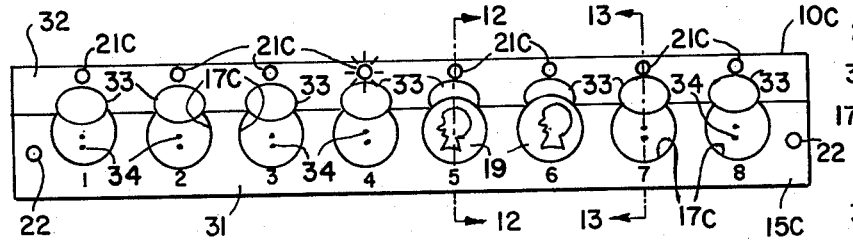
FIG. 11
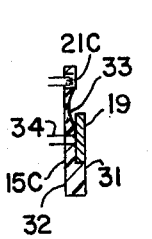
FIG. 12
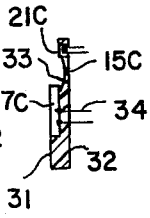
FIG. 13

APPLIANCE FOR COIN-OPERATED DEVICES

BACKGROUND OF THE INVENTION

1. Field of the Invention

This invention relates to coin handling and more particularly to special attachments and accessories for coin-operated devices having coin receiving means.

2. Description of the Prior Art

Various types of coin holding devices have been known to the prior art. Coin holders have been used in coin purses, handbags, vanity cases and the like. Generally, these coin holders were carried by the owner of the coins to keep the coins separated.

A special problem exists for coin-operated devices available for public use. Coin-operated amusement devices such as pool tables, pinball machines, hockey games, video display games and the like usually take between five to fifteen minutes to complete a game. A similar time of use occurs in a coin-operated laundry or dry cleaning facilities. Accordingly, the order of prospective use of the coin-operated device is not readily discernable to the prospective users. In many parts of the United States, prospective users align coins on a surface in proximity to the coin-operated device to indicate the order of use of the coin-operated device. However, the coins can be easily misaligned causing confusion among the prospective users. In addition, such practices are only local customs and visitors are not aware of such customs.

Accordingly, an object of this invention is to overcome the aforementioned disadvantages associated with coin-operated devices by providing an appliance for illustrating the order of use by a plurality of prospective users.

Another object of this invention is to provide an appliance for a coin-operated device having means for displaying the order in which a plurality of coins are placed in a plurality of coin retaining means by a plurality of users.

Another object of this invention is to provide an appliance for a coin-operated device including indicator means for indicating the one of the plurality of coin retaining means corresponding to the present user of the coin-operated device.

Another object of this invention is to provide an appliance for a coin-operated device having coin retaining means wherein the coins of prospective users are secure from accidental misalignment.

Another object of this invention is to provide an appliance for a coin-operated device having means for automatically indexing the indicator means in a sequence each time a coin is inserted within the coin-operated device.

Another object of this invention is to provide an appliance for a coin-operated device wherein the indexing of the indicator means can be accomplished by an electrical or mechanical output signal.

Another object of this invention is to provide an appliance for a coin-operated device which is readily adaptable to existing coin-operated devices and which may be incorporated within further coin-operated devices.

SUMMARY OF THE INVENTION

The invention may be incorporated into an appliance for illustrating the order of prospective use by a plurality of sequential users of a coin-operated device having coin-receiving means, comprising in combination, support means having a plurality of coin retaining means with each of said coin retaining means being capable of retaining a coin which is insertable in the coin receiving means of the coin-operated device, display means for displaying the order in which a plurality of coins are placed in said plurality of coin retaining means by a plurality of users, respectively, indicator means for indicating the one of said plurality of coin retaining means corresponding to the present user of the coin-operated device, and means mounting said display means and said indicator means for enabling inspection thereof to indicate the order of prospective use of the coin-operated device by the plurality of users in accordance with said display means and said indicator means.

Other objects and a fuller understanding of the invention may be had by referring to the following description and claims, taking in conjunction with the accompanying drawings.

BRIEF DESCRIPTION OF THE DRAWINGS

FIG. 1 is a perspective view of the invention mounted on an upper surface of a coin-operated pocket billiard device;

FIG. 2 is an enlarged plan view of the invention shown in FIG. 1;

FIG. 3 is a sectional view along line 3—3 of FIG. 2;

FIG. 4 is a sectional view along line 4—4 of FIG. 2;

FIG. 5 is a plan view of a first modification of the invention shown in FIG. 1–4;

FIG. 6 is a sectional view along line 6—6 of FIG. 5;

FIG. 7 is a sectional view along line 7—7 of FIG. 5;

FIG. 8 is a plan view of a second modification of the invention shown in FIGS. 1–4;

FIG. 9 is a sectional view along line 9—9 of FIG. 8;

FIG. 10 is a sectional view along line 10—10 of FIG. 8;

FIG. 11 is a plan view of a third modification of the invention shown in FIGS. 1–4;

FIG. 12 is a sectional view along line 12—12 of FIG. 11;

FIG. 13 is a sectional view along line 13—13 of FIG. 11;

DESCRIPTION OF THE PREFERRED EMBODIMENT

Figure 14:
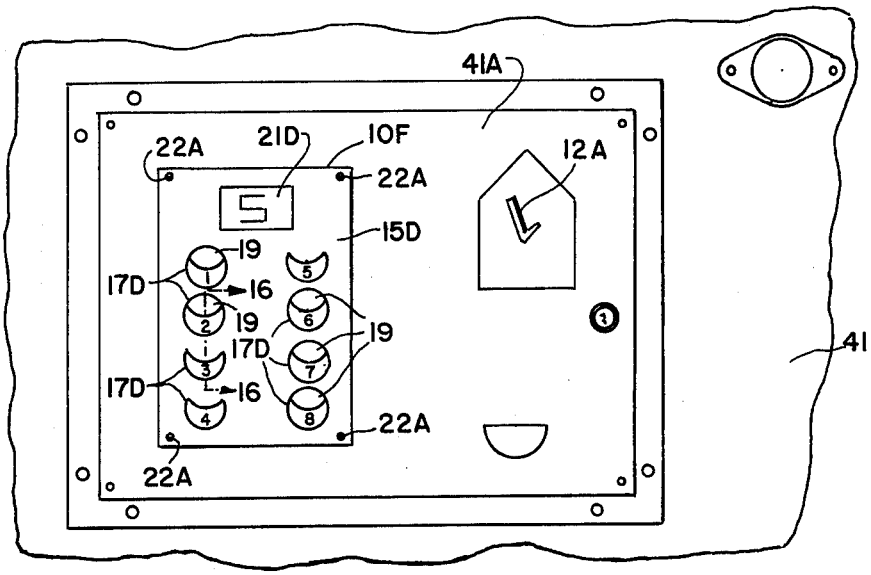
FIG. 14 is a plan view of a fourth modification of the invention shown in FIG. 1–4 mounted on a pinball device.

FIG. 1 is a perspective view of an appliance 10 for a coin-operated device 11 shown as a coin-operated pocket billiard machine. Although the coin-operated device 11 is shown as a pocket billiard machine, it is understood that the instant invention is equally applicable to all types of amusement devices such as pinball machines, bowling machines, video display machines in addition to other coin-operated devices including washing machines, dryers, dry cleaning machines and the like. The coin-operated device 11 includes coin receiving means 12. Each time a coin (typically a quarter) is inserted into the coin receiving means 12, billiard balls are released into a holder 13 enabling the balls to be placed on the top of the billiard table. The balls placed in the pockets of the table are stored until an additional coin is inserted into the coin receiving means 12 for the next game. Typically a pocket billiard game may last between 5 and 15 minutes so a player may have to wait several hours during substantial use of the coin-operated device 11. This makes the order of prospective use of the coin-operated device unclear and uncertain.

The instant invention illustrates the order of prospective use by a plurality of users of the coin-operated device 11 and comprises support means or a support 15 having a plurality (eight) of coin retaining means 17 shown as indentations with each of the indentations 17 being capable of retaining a coin 19 which is insertable in the coin receiving means 12 of the coin-operated device 11. The invention includes display means for displaying the order in which a plurality of coins are inserted in the plurality of indentations 17 by a plurality of users, respectively. The display means includes the coin retaining means 17 being located in a logical sequence along the support 15 and with each of the coin retaining means 17 being sequentially numbered 1–8. Indicator means shown as a marker 21 is at least partially insertable within each of the indentations 17 for indicating the one of the plurality of coin retaining means 17 corresponding to the present user of the device 11. The appliance 10 is mounted through apertures 22 and conventional means (not shown) to an upper surface 11A of the coin-operated device 11 for enabling inspection of the display means and the indicator by the plurality of user to indicate the prospective order of use of the device 11 by the plurality of users. Although the support means 15 has been shown to be a distinct part from the upper surface 11A of the coin-operated device, it is understood that the support means 15 may be an integral part of the upper surface 11A of the coin-operated device.

FIG. 2 is an enlarged plan view of the invention shown in FIG. 1. The appliance 10 may be a unitary piece of material such as plastic or the like with the coin receiving means 17 being molded for receiving approximately one-half of a coin such as a quarter. The appliance is designed for mounting to an inclined or horizontal surface by a conventional means extending through the apertures 22. The numbers 1–8 associated with the eight coin retaining means 17 are optional and may be molded into the support means 15 during manufacturing. The marker is insertable in each of the coin retaining means 17 to show the present user of the coin-operated device 11. The marker is preferably made of a size or shape to be incapable of insertion within the coin receiving means 12 of a coin-operated device 11.

FIG. 3 is a sectional view along line 3—3 of FIG. 2 showing the relative thickness between the coin 19 and the support means 15 of the appliance 10.

FIG. 4 is a sectional view along line 4—4 of FIG. 2 showing the coin retaining means or indentation 17 extending into the support means 15.

FIG. 5 is a first modification of the invention shown in FIGS. 1–4 illustrating an appliance 10A having support means 15A with a plurality of coin retaining means 17A. In this embodiment the coin retaining means 17A receives at least half of the coin 19. A marker 21A is insertable within each of the coin retaining means 17A and is secured by a connector 24 such as a wire or the like making the marker 21A incapable of insertion within the coin receiving means 12 of the coin-operated device 11.

FIG. 6 is a sectional view along line 6—6 of FIG. 5 showing the support means 15A receiving at least half of the coin 19 with the support means 15A covering the sides of the coin 19. Accordingly, the support means 15A may be mounted to a vertical, inclined or horizontal surface.

FIG. 7 is a sectional view along line 7—7 of FIG. 5 illustrating the position of the coin retaining means 17A in the support means 15A.

FIG. 8 is a second modification of the invention shown in FIGS. 1–4 illustrating an appliance 10B comprising support means 15B having a plurality of coin retaining means 17B. The coin retaining means 17B are indentations along the support means 15B with each indentation 17B being capable of totally receiving a coin 19 within the support means 15B. A plurality of removal notches 26 are respectively located adjacent the plurality of indentations 17B exposing a portion of the totally received coins to enable removal thereof by a user. The indicator means includes a cutout 27 in the support 15B with a rod or wire 28 extending along the length of the support 15B adjacent the plurality of coin retaining means 17B. A marker 21B is slideable along the rod 28 for indicating the present user of the coin-operated device 11 by the position of the marker 21B relative to the plurality of coin retaining means 17B.

FIG. 9 is a sectional view along line 9—9 in FIG. 8 illustrating the totally received coin 19 within the support 15B and the positions of the cutout 27 and the rod 28.

FIG. 10 is a sectional view along line 10—10 in FIG. 8 showing the coin retaining means 17B, the marker 21B and the removal notch 26 in the support means 15B. Since the coin 19 is substantially totally received by the support means 15B, the support 15B may be mounted in a vertical, inclined, or horizontal orientation.

FIG. 11 is a third modification of the invention shown in FIGS. 1–4. The support means 15C of the appliance 10C comprises a front member 31 and a rear member 32 which may be two separate members or a unitary member. The front 31 includes a plurality of coin retaining means 17C which are shown as semi-circular indentations which are capable of receiving over 50 percent of the coin 19. Accordingly, the coin cannot slip out but must be picked up from the coin retaining means 17C. The rear member 32 extends adjacent the indentations 17C to support the coins 19 when the support 15C is located in an horizontal or inclined orientation. The rear member 32 has a plurality of thumb notches 33 to effect removal of the coins 19 in the coin retaining means 17C. The indicator means is shown as a plurality of light emitting devices 21C adjacent the plurality of the coin retaining means 17C, respectively. The indicator means includes sensor means 34 in the coin retaining means 17C as hereinafter described.

FIG. 12 is a sectional view along line 12—12 of FIG. 11 of the support 15C with the coin 19 shown in contact with the sensor means 34.

FIG. 13 is a sectional view along line 13—13 of FIG. 11 illustrating the position of the coin retaining means 17C relative to the support 15C.

FIG. 14 shows a coin-operated device 41 shown as a pinball machine having a substantially vertical surface 41A and coin receiving means 12A to energize the machine. A fourth modification of the invention is shown as an appliance 10F mounted by conventional means shown as screws 22A to the surface 41A. The support 15D includes a plurality of coin retaining means 17D and indicator means 21D for numerically indicating the present user of the coin-operated device 41. The indicator 21D may be any one of the numerous types of digital readouts which are well-known to the electronic art.

Figure 16:
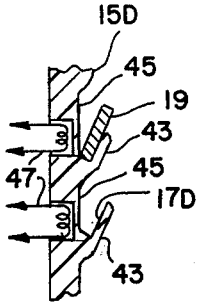
FIG. 16 is a partial enlarged view along line 16—16 of FIG. 14.

FIG. 16 is a partial enlarged sectional view along line 16—16 of FIG. 14. Each of the coin retaining means 17D includes a tab 43 extending from the support means 15D forming an acute angle with a surface 45 of the support 15D. A coin 19 is held within the acute angle formed by the tab 43 and the surface 45. Behind each of the coin retaining means 17D lies a sensing coil 47 for sensing the presence of a coin 19 in the coin retaining means 17D which will be hereinafter described.

The invention is used in the following manner referring to FIGS. 2, 5, 8, 11 and 14 in succession. Assume that the coin-operated device 11 is already in present use. The next six prospective users will sequentially insert quarters into coin retaining means numbered 1–6, respectively, in FIG. 2. After completion of the previous game, the first user will remove his coin from the coin retaining means numbered (1) and insert the coin into the device 11. The marker 21 is then placed in the coin retaining means numbered (1) as shown in FIG. 2. Upon termination of use by the first user, the second user will remove his coin from the coin retaining means numbered (2) and insert the coin into the device 11. The marker is then moved to the number 2 position as shown in FIG. 5. Upon completion by the second user, the third user will insert his coin into the coin-operating device 11 and the marker is moved to the (3) position as shown in FIG. 8. Accordingly, prospective users 4–6 can quickly ascertain the sequence of use by the numbers and the physical location of their respective coins in relation to the indicator means. Upon completion by the third user, the fourth user will insert his coin into the coin-operated device 11 and the marker will indicate the fourth player is now using the device 11. The dashed lines about the marker 21C in FIG. 11 adjacent the fourth coin retaining means illustrate that the light is burning.

FIG. 14 assumes that four additional users desire to use the device and accordingly the four users have sequentially placed their coins in the coin retaining means labeled 7,8,1, and 2. Upon completion by the fourth user, the fifth user will insert his coin into the coin-operated device and the indicator means 21D will be established to indicate that the fifth user is presently using the device as shown in FIG. 14. The users having the coins in the 7,8,1, and 2 positions in the coin retaining means will be the next first through fourth prospective users of the coin-operated device respectively. After the marker has been established in the final coin retaining means, shown as (8), it is then returned to the first coin retaining means, shown as (1), to continue the sequence. The invention allows the process to continue irrespective of this position of the indicator means.

Figure 15:
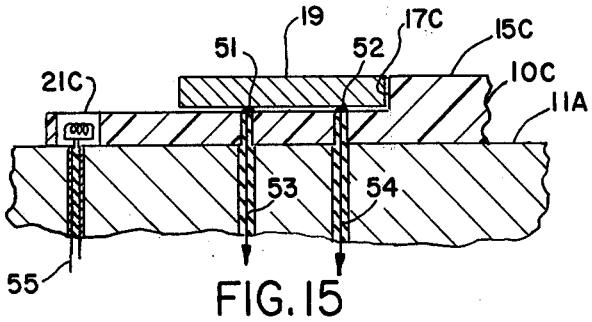
FIG. 15 is a partial enlarged view similar to FIG. 12 of an appliance according to the invention mounted on a horizontal surface.

FIGS. 11–16 illustrate electronic indicator means with FIGS. 15 and 16 illustrating means for sensing the insertion of a coin in the coin retaining means of the appliance. FIG. 15 is a partial enlarged view similar to FIG. 12 showing the appliance 10C mounted to a horizontal surface 11A. A first and a second contact 51 and 52 are respectively connected by wires 53 and 54 to an electronic circuit shown in FIG. 17. The first and second contacts 51 and 52 are interconnected by the coin 19 to form a circuit with the electronic means of FIG. 17 when the coin is inserted in the coin retaining means 17C.

Figure 17:
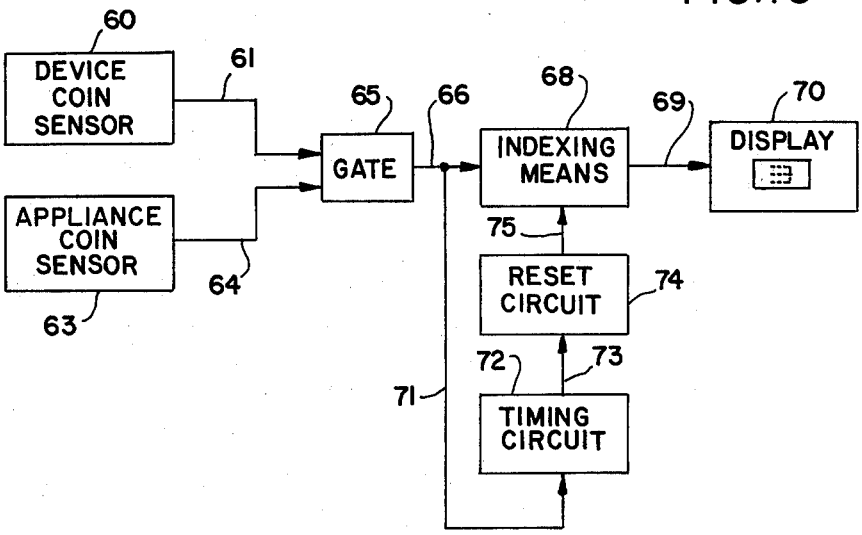
FIG. 17 is a block diagram of an electrical circuit for use with the inventions in FIG. 11–16.

The indicator means 21C is shown as a filament lamp having connector means 55, which forms a part of the display 70 shown in FIG. 17. FIG. 16 illustrates non-contact means for sensing the presence of a coin 19. The coils 47 represent sensors for providing a signal in the appliance sensor 63 in FIG. 17 upon the presence of the coin 19 within the coin receiving means 17D. Non-contact sensing or proximity probes are well-known in the art and will not be explained herein. However, it is clear that the sensing of a coin can be done mechanically, electrically, magnetically, or optically.

FIG. 17 is a block diagram of electronic means for automatically indexing the indicator means of FIGS. 11–14. A device coin sensor 60 may be mounted within the coin-operated device to provide a signal on line 61 each time a coin is inserted in the coin receiving means of the coin-operated device. An appliance coin sensor 63 provides a signal along line 64 each time a coin is present in any one of the coin retaining means of the appliance. The appliance coin sensor may include either of the sensing devices shown in FIGS. 15 and 16 or other suitable sensing devices. Simultaneous electric signals to gate 65 from lines 61 and 64 will produce a signal on line 66 which will trigger an indexing means 68. The output of the indexing means 68 is applied by line 69 to a display 70 such as 21C in FIG. 11 or 21D in FIG. 14, or any other suitable display. For example, the indexing means may be a mechanical stepping relay, an electronic counting circuit or the like which will index each time a signal is applied on line 66. The indexing means will index from the maximum numerical output (8), to the minimum numerical output (1) upon indexing after presentation of the maximum numerical output 8. The sequence of light emission shown in FIG. 11 will likewise energize the light adjacent the (1) coin retainer upon indexing after the light adjacent the (8) coin retainer has been energized. The display 70 may be mounted remotely from the coin retaining means such as on a pool cue rack or other prominent place to display the present user of the coin-operated device. Line 66 is connected through line 71 to a timing circuit 72 which times the duration since the last signal on line 66 from the gate 65. An absence of signal on line 66 for a predetermined period of time, for example, 15 minutes, provides a signal to trigger the reset circuit 74 through line 73. The reset circuit 74 resets the indexing means through a line 75 to the minimum numerical presentation. In addition, the reset circuit 74 inhibits the display 70. The termination of display conserves the electrical consumption of the apparatus when it is not in use. The predetermined period of time in the timing circuit may be variable to adapt to the needs of various devices.

For example, if a sole player inserts a coin directly into the coin receiving means of the coin-operated device, then a signal will appear on line 61 but no signal will appear on line 64 since all coin retaining means are empty. Accordingly, the display will not operate. In addition, after 15 minutes of nonuse of the device, the indexing means 68 will be reset so that the appliance will start the next time at the minimum numerical presentation. The lighted display will terminate upon nonuse of the device for a predetermined period of time.

The present disclosure includes that contained in the appended claims, as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and the scope of the invention as hereinafter claimed.

What is claimed is:

1. An appliance for illustrating the order of prospective use by a plurality of sequential users of a coin-operated device having coin receiving means, comprising in combination:

support means having a plurality of coin retaining means with each of said coin retaining means being capable of retaining a coin which is insertable in the coin receiving means of the coin-operated device;

each of said coin retaining means having a coin inserting and withdrawing aperture which exceeds the diameter of the coin to permit insertion and withdrawal of a coin without physical interference between a coin and said coin retaining means;

display means for displaying the order in which a plurality of coins are placed in said plurality of coin retaining means by a plurality of users, respectively;

indicator means for indicating the one of said plurality of coin retaining means corresponding to the present user of the coin-operated device;

and means mounting said display means and said indicator means for enabling inspection thereof to indicate the order of prospective use of the coin-operated device by the plurality of users in accordance with said display means and said indicator means.

2. An appliance as set forth in claim 1, wherein said display means includes said plurality of coin retaining means being located in a sequence.

3. An appliance as set forth in claim 1, wherein said display means includes said plurality of coin retaining means being sequentially numbered.

4. An appliance as set forth in claim 1, wherein said mounting means includes means for mounting said support means in proximity to the coin receiving means of the coin-operated device.

5. An appliance as set forth in claim 1, wherein said indicator means indicates only one of said plurality of coin retaining means.

6. An appliance as set forth in claim 1, wherein said indicator means is capable of cooperation with each of said plurality of coin retaining means and is incapable of insertion in the coin receiving means of the coin-operated device.

7. An appliance as set forth in claim 1, wherein each of said coin retaining means is an indentation in said support means;

and said display means includes said indentations being located along said support means with said indentations being sequentially numbered.

8. An appliance as set forth in claim 1, wherein said indicator means includes means establishing a changeable indicator relative to said support means for indicating the present user of the coin-operated device by the position of said changeable indicator relative to said plurality of coin retaining means.

9. An appliance as set forth in claim 1, wherein said indicator means includes a marker slidably mounted to said support means for indicating the present user of the coin-operated device by the position of said marker relative to said plurality of coin retaining means.

10. An appliance as set forth in claim 1, wherein said plurality of coin retaining means includes a plurality of indentations along said support means with each of said indentations being capable of partially receiving a coin within said support means whereby the received coin is partially exposed.

11. An appliance as set forth in claim 1, wherein said plurality of coin retaining means includes a plurality of indentations along said support means with each of said indentations being capable of totally receiving a coin within said support means;

and a plurality of removal notches located relative to said plurality of indentations in said support means for exposing a portion of the totally received coin to enable removal thereof.

12. An appliance as set forth in claim 1, wherein said support means includes a front portion and a rear portion;

said plurality of coin retaining means being indentations in said front portion with each of said indentations being capable of at least partially receiving a coin;

and said rear portion extending adjacent said indentations to support the coins within said plurality of indentations.

13. An appliance as set forth in claim 1, wherein said plurality of coin retaining means includes a plurality of tabs extending from said support;

and each of said tabs forming an acute angle with a surface of said support means for retaining a coin between said surface and said tab.

14. An appliance as set forth in claim 1, wherein said indicator means includes a marker which is at least partially insertable in said coin retaining means with said marker being of a shape different from the coin to prevent insertion of said marker in the coin receiving means of the coin-operated device.

15. An appliance as set forth in claim 1, wherein said indicator means includes a marker which is at least partially insertable in said coin retaining means;

and means connecting said marker to said support means to prevent insertion of said marker in the coin receiving means of the coin-operated device.

16. An apparatus as set forth in claim 1, wherein said indicator means includes sensor means for sensing the insertion of a coin in the coin receiving means of the coin-operated device;

and means connecting said sensor means to said indicator means for indexing the indicator means in a sequence each time a coin is inserted within the coin receiving means of the coin-operated device.

17. An appliance as set forth in claim 16, wherein said indicator means include light emitting means.

18. An appliance as set forth in claim 16, wherein said indicator means includes a numerical presentation.

19. An appliance as set forth in claim 16, wherein said indicator means includes device sensor means providing a device electrical output signal upon insertion of a coin in the coin receiving means of the coin-operated device;

appliance sensor means providing an appliance electrical output signal upon sensing a coin in one of said coin retaining means;

light emitting means being indexable in a sequence for indicating the present user of the coin-operated device;

and indexing means interconnecting said sensor means and said light emitting means for indexing said light emitting means upon a simultaneous electrical output signal from said device and appliance sensor means.

20. An appliance as set forth in claim 19, wherein said indicator means includes a numerical presentation having a maximum numerical presentation equal to the total number of said plurality of coin retaining means;

and said indicator means includes means for resetting said numerical presentation to a minimum numerical presentation upon indexing after presentation of said maximum numerical presentation.

21. An appliance as set forth in claim 19, wherein said light emitting means includes a plurality of light emitting devices mounted adjacent said plurality of coin retaining means respectively.

22. An appliance as set forth in claim 19, including a reset circuit for resetting said indexing means upon an absence of an electrical output signal from said sensor means for a predetermined period of time.

23. An appliance as set forth in claim 19, including a reset circuit for disabling said light emitting means upon an absence of an electrical output signal from said sensor means for a predetermined period of time.

24. An appliance as set forth in claim 19, wherein said appliance sensor means includes a first and a second electrical contact associated with each of said coin retaining means;

and means for mounting said first and second contacts to be interconnected by a coin inserted within said coin retaining means.

25. An appliance as set forth in claim 19, wherein said appliance sensor means includes a proximity probe for sensing the presence of a coin in each of said plurality of coin retaining means.

* * * * *